US005472638A

United States Patent [19]

McLaughlin et al.

[11] Patent Number: 5,472,638

[45] Date of Patent: Dec. 5, 1995

[54] CORROSION INHIBITOR

[75] Inventors: Bruce D. McLaughlin, Sewell, N.J.; Tsoung Y. Yan, Philadelphia, Pa.

[73] Assignee: Mobil Oil Corp., Fairfax, Va.

[21] Appl. No.: 234,449

[22] Filed: Apr. 28, 1994

Related U.S. Application Data

[63] Continuation-in-part of Ser. No. 67,884, May 28, 1993, abandoned, which is a continuation-in-part of Ser. No. 874,469, Apr. 27, 1992, abandoned.

[51] Int. Cl.[6] ..... C23F 11/14; C23F 11/16; C23F 15/00

[52] U.S. Cl. ..... 252/391; 252/390; 252/189; 252/190; 423/228; 423/229; 588/215; 588/216; 588/218; 588/221; 588/228; 422/16; 208/47

[58] Field of Search ..... 564/500, 501; 252/189, 190, 392; 422/16; 423/228, 229; 208/47; 588/215, 216, 218, 221, 228

[56] References Cited

U.S. PATENT DOCUMENTS

| | | | |
|---|---|---|---|
| 3,245,752 | 4/1966 | Fryar et al. | 423/229 |
| 4,071,470 | 1/1978 | Davidson et al. | 423/229 |

*Primary Examiner*—Gary L. Geist
*Assistant Examiner*—Valerie Fee
*Attorney, Agent, or Firm*—Alexander J. McKillop; Dennis P. Santini; Robert B. Furr, Jr.

[57] ABSTRACT

A corrosion inhibitor is disclosed which is produced by reacting an aqueous alkanolamine solution with an acid gas to form an amide and an alkanolamine salt, mixing aqueous alkanolamine with said amide and said alkanolamine salt in the absence of added inorganic base, and reacting the mixture at elevated temperature.

9 Claims, 4 Drawing Sheets

CORROSION INHIBITOR

CROSS-REFERENCE TO RELATED APPLICATIONS

This is a Continuation-in-Part of U.S. application Ser. No. 08/067,884 filed May 28, 1993 now abandoned, which is a continuation-in-part of Ser. No. 07/874,469, filed Apr. 27, 1992, now abandoned.

FIELD OF THE INVENTION

The present invention relates to the synthesis and application of corrosion inhibitors. More specifically, the invention relates to a method for converting a hazardous waste stream into a valuable corrosion inhibiting additive.

BACKGROUND OF THE INVENTION

The addition of relatively small amounts of a corrosion inhibitor to a system retards or prevents corrosive degradation of the metal. Because corrosion inhibitors are typically added to a system in relatively small dosages, for example, less than 10 percent by weight of total fluid in the system, the expense associated with the additive program is typically justified by reduced maintenance costs and longer equipment life. A low-cost corrosion inhibitor would be particularly beneficial, not only from the standpoint of operating costs, but also because its low cost would effectively remove any economic constraints on the maximum allowed dosage.

Acid gas sorption processes, commonly used in the oil refining, natural gas recovery, and wood pulp industries, generally require alloy construction and/or the addition of corrosion inhibitors to prolong the life of the process equipment. These process units remove $H_2S$ and $CO_2$ from gaseous process streams, typically by countercurrently contacting an aqueous solution containing from about 20% to about 50% by weight of an alkanolamine with a gas stream containing $H_2S$ and/or $CO_2$. As used herein, the terms "alkanolamine" and "ethanolamine" are generic terms including, but not limited to, monoethanolamine, diethanolamine, triethanolamine, and methyl diethanolamine.

The removal of hydrogen sulfide from gaseous streams, such as the waste gases liberated in the course of various chemical and industrial processes, for example, in wood pulping, natural gas and crude oil production and in petroleum refining, has become increasingly important in combating atmospheric pollution. Hydrogen sulfide containing gases not only have an offensive odor, but such gases may cause damage to vegetation, painted surfaces and wildlife, and further may constitute a significant health hazard to humans. Government-wide regulations have increasingly imposed lower tolerances on the content of hydrogen sulfide which can be vented to the atmosphere, and it is now imperative in many localities to remove virtually all the hydrogen sulfide under the penalty of an absolute ban on continuing operation of a plant or the like which produces the hydrogen sulfide-containing gaseous stream. Solutions of water and one or more the alkanolamines are widely used in industry to remove hydrogen sulfide and carbon dioxide from such gaseous streams.

Corrosion in alkanolamine units significantly increases both operating and maintenance costs. The mechanisms of corrosive attack include general corrosive thinning, corrosion-erosion, and stress-corrosion cracking. Corrosion control techniques include the use of more expensive corrosion and erosion resistant alloys, continuous or periodic removal of corrosion-promoting agents in suspended solids by filtration, activated carbon adsorption, addition of corrosion inhibitors, or purging of the circulating alkanolamine. See, for example, Kohl, A. L. and Reisenfeld, F. C., *Gas Purification,* Gulf Publishing Company, Houston, 1979, pp. 91–105, as well as K. F. Butwell, D. J. Kubec and P. W. Sigmund, "Alkanolamine Treating", *Hydrocarbon Processing,* March, 1982.

U.S. Pat. No. 4,795,565 to Yan describes a process for removing heat stable salts from an ethanolamine system by the use of ion exchange resins. The disclosure of U.S. Pat. No. 4,795,565 to Yan is incorporated herein by reference for the operating details both of an ethanolamine acid gas sorption system as well as for the heat stable salt removal process. See also Keller et al., *Heat Stable Salt Removal From Amines by the HSSX Process Using Ion Exchange,* presented to The Laurence Reid Gas Conditioning Conference, March 2, 1992.

The chemistry of alkanolamine degradation is discussed in the Butwell et al. article cited above. Briefly, the Butwell et al. article notes that monoethanolamine (MEA) irreversibly degrades to N-(2-hydroxyethyl) ethylene diamine (HEED). HEED shows reduced acid gas removal properties and becomes corrosive at concentrations of at least about 0.4% by weight.

Diglycolamine (DGA), on the other hand, is said to produce a degradation product upon reaction with $CO_2$ which exhibits different properties. DGA is a registered trademark of Texaco, Inc. which identifies an amine having the chemical formula $NH_2$—C $_2H_4$—O-$C_2H_4$-OH. DGA degrades in the presence of $CO_2$ to form N,N'-bis(hydroxyethoxyethyl) urea (BHEEU) which is similar to HEED in corrosivity but differs in that BHEEU has no acid gas removal properties.

Diethanolamine (DEA) reacts with $CO_2$ to form N,N'-di(2-hydroxyethyl) piperazine. Unlike HEED and BHEEU, the piperazine compound is noncorrosive and has acid gas removal properties essentially equal to its parent, DEA. See the Butwell et al. article at page 113.

Diisopropylamine (DIPA) readily degrades in the contact with $CO_2$ to form 3-(2-hydroxypropyl) 5-methyl oxazolidone which shows essentially no acid gas removal properties. See the Butwell et al. article at page 113.

U.S. Pat. No. 4,281,200 to Snoble teaches a process for recovering diisopropanolamine from the cyclic reaction products formed by reacting $CO_2$ with diisopropanolamine which process comprises reacting the cyclic product with an inorganic base at temperatures between about 105° and 200° C.

U.S. Pat. No. 4,971,718 to McCullough et al. teaches a method for treating a gas stream with an aqueous solution containing an monoethanolamine, a methyldiethanolamine, and antimony in concentration of at least 100 ppm.

U.S. Pat. No. 4,944,917 to Madden et al. discloses a method for inhibiting corrosion in an aqueous amine scrubbing solution in contact with $H_2S$, which method contacting the aqueous amine solution with $H_2S$ in the presence of an ammonium or alkali-metal thiosulfate salt and an effective amount of sulfide and/or hydrosulfide ions.

U.S. Pat. No. 4,857,283 to Madden teaches the use of sulfur dioxide for inhibiting corrosion in an amine-containing acid gas scrubbing solution.

U.S. Pat. No. 4,764,354 to Kubek et al. discloses a method for reducing the corrosion rate of carbon steel in contact with an alkanolamine solution in an acid gas scrubbing process, which method comprises maintaining specified levels of hydrogen sulfide and vanadium in the plus five valence state in the alkanolamine solution.

U.S. Pat. No. 4,690,740 to Cringle et al. relates to a technique for inhibiting corrosion in an alkanolamine acid gas sorption system which comprises maintaining a copper ion in the plus two oxidation state by applying an induced or impressed voltage across a point, or across several points in the circulating copper-containing solution.

U.S. Pat. No. 4,631,138 relates to the use of triazones and triazine thiones as corrosion inhibitors.

U.S. Pat. No. 4,596,849 to Henson et al. teaches a corrosion inhibiting composition for ferrous metals and alloys, which composition includes a thiourea-amine-formaldehyde based polymer, and, preferably, a cupric ion-producing material. U.S. Pat. No. 4,595,723 to Henson et al. teaches an additive having a composition similar to that disclosed in the '849 Henson et al. patent, but preferably contains a nickel ion-producing material.

U.S. Pat. No. 4,590,036 relates to an additive for inhibiting corrosion in an amine-containing gas scrubbing system comprising a mixture of antimony and molybdenum metal salts.

U.S. Pat. No. 4,502,979 discloses corrosion inhibiting compositions for use in alkanolamine solutions comprising combinations of vanadium compounds and an organic compound selected from the group consisting of nitro-substituted aromatic acids, nitro-substituted acid salts, and 1,4-naphthoquinone, preferably from the group consisting of p-nitrobenzoic acid, m-nitrobenzoic acid, 3,5-dinitrobenzoic acid, p-nitrophenol, m-nitrophenol, m-nitrobenesulfonic acid, 1,4-naphthoquinone, and mixtures thereof.

U.S. Pat. No. 4,499,003 relates to an aqueous corrosion inhibitor composition comprising soluble antimony and molybdenum salts wherein the weight ratio of soluble antimony salt to molybdenum salt ranges between 0.01 and 1 and about 5 to 1.

SUMMARY OF THE INVENTION

The present invention provides a corrosion inhibitor produced by reacting an alkanolamine in aqueous solution together with (a) an amine salt formed by the reaction of $CO_2$ and/or $H_2S$ with the alkanolamine; and (b) an amide formed by the reaction of $CO_2$ and/or $H_2S$ with the alkanolamine at elevated temperature of from about 180° to about 350° C., preferably from about 200° to about 300° C. for reaction time of from about 0.1 to about 20 hours, preferably from about 1.0 to about 5 hours. The heating step is preferably carried out under pressure conditions such that essentially all water in the feed vaporizes to produce a substantially water-free liquid product. The heating step is further preferably conducted in the absence of added catalyst. Particularly, inorganic bases should be avoided becauses these bases tend to form heat-stable salts which undesirably contaminate the product. The presence of inorganic bases at low concentrations as feed impurities may be tolerated, but he method of this invention preferably avoids the presence of inorganic base altogether. The steps of the present process are preferably carried out sequentially. Particularly, the aqueous alkanolamine feed solution must be at least partially deactivated by contacting the solution with an acid gas prior to the elevated temperature treatment step. The alkanolamine feed solution preferably contains from about 15 to about 98 weight percent alkanolamine from about 1 to about 20 weight percent of the amine salt, and from about 1 to about 20 weight percent of the amide. The alkanolamine feed solution may comprise fresh alkanolamine, for example, reagent grade alkanolamine, or may alternatively comprise a spent alkanolamine waste stream withdrawn from a commercial alkanolamine acid gas sorption process as taught in U.S. Pat. No. 4,795,565 to Yan, cited above.

Useful alkanolamine feedstocks include, but are not limited to, ethanolamine, diethanolamine, and methyl-diethanolamine. Either fresh or spent alkanolamine feed may be used, but if the feed is a fresh alkanolamine, it is preferable to react the fresh alkanolamine feed with an acidic catalyst in a pretreatment step to at least partially convert the alkanolamine to amine salts and amides prior to reacting said alkanolamine feed at elevated temperature. Suitable acidic catalysts include aqueous solutions of acid gases such as CO, $CO_2$ and $H_2S$.

The invention further provides a method of decreasing the rate of corrosive attack of a liquid solution on a ferrous metal or alloy, said method comprising adding the corrosion inhibitor of the invention to a liquid solution in concentration of from about 0.1 to about 8.0 weight percent, preferably from about 1 to about 5 weight percent. This method finds particular utility in alkanolamine acid gas sorption systems.

The invention also includes a method for disposing of a liquid hazardous waste stream containing an alkanolamine and degradation products formed by contacting said alkanolamine with an acid, said method comprising reacting said hazardous waste stream at elevated temperature of from about 180° to about 350° C. for reaction time of from about 0.1 to about 20 hours. Through this process, a spent alkanolamine solution may be upgraded from a hazardous waste to a useful corrosion inhibitor.

While the corrosion inhibitor of the invention is useful with various alkanolamine gas sorption systems, its utility is not limited to such systems. The corrosion inhibitor of the invention is also useful to control corrosion in crude unit overhead systems, as well as in gas oil systems subjected to naphthenic acid attack. As used herein, the term "crude unit overhead" includes conduit, valves, vessels, and heat exchange equipment associated with the upper sections of crude oil distillation towers.

The invention further comprises a method of decreasing the rate of corrosive attack of a liquid solution on a ferrous metal or alloy, said method comprising adding the corrosion inhibitor of claim 10 to said liquid solution in concentration of from about 0.1 to about 8.0 weight percent. The mechanism by which the additive of the invention inhibits corrosion is not fully understood, although the inhibiting effect is clear from the examples as set forth below. The corrosion inhibitor may be added to a system by any suitable means, for example, continuous injection or by slug dosing, although continuous injection is preferred. For crude unit overhead corrosion control, the additive of the invention may be injected upstream or downstream of the overhead condenser, or may be added directly to the condenser exchanger. Alternatively, the additive may be added to a slip stream withdrawn from the crude unit overhead system upstream of the condenser exchanger which slip stream is then charged back to the crude unit overhead system at a point selected to maximize mixing between the crude unit overhead process stream and the additive-enriched slipstream.

EXAMPLES

Examples 1–16 characterize the corrosivity of aqueous amine solutions containing reagent grade amine. The tests were conducted under the following conditions:

Temperature, °F.: 140, 212, 240 and 260

$H_2S$ loading, mole/mole amine: 0, 0.05; 0.20, 0.25; 0.45, 0.5, and 0.66.

Amine concentration, 25 wt. % and 35 wt. %.

Figure 2:
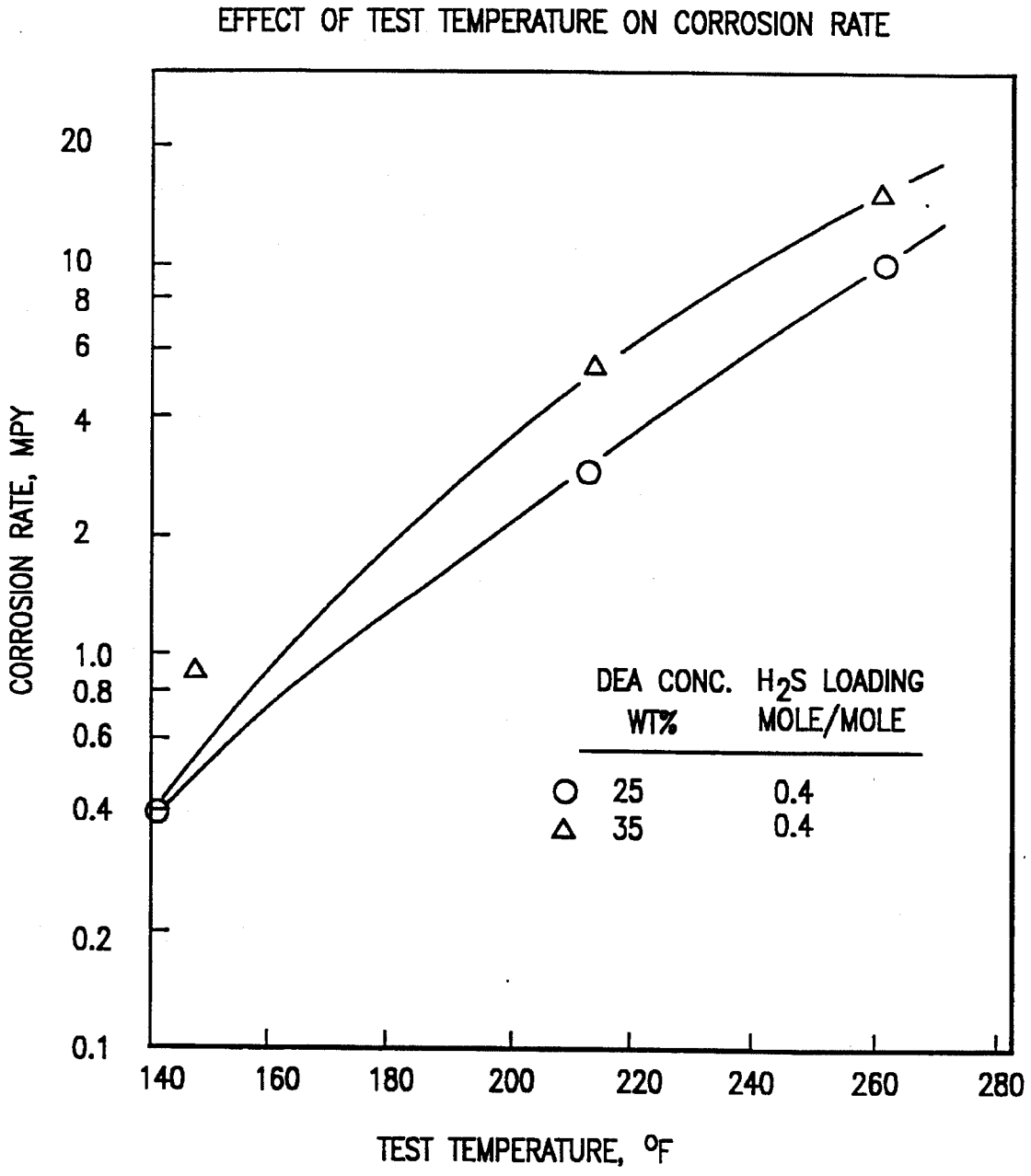
Figure 3:
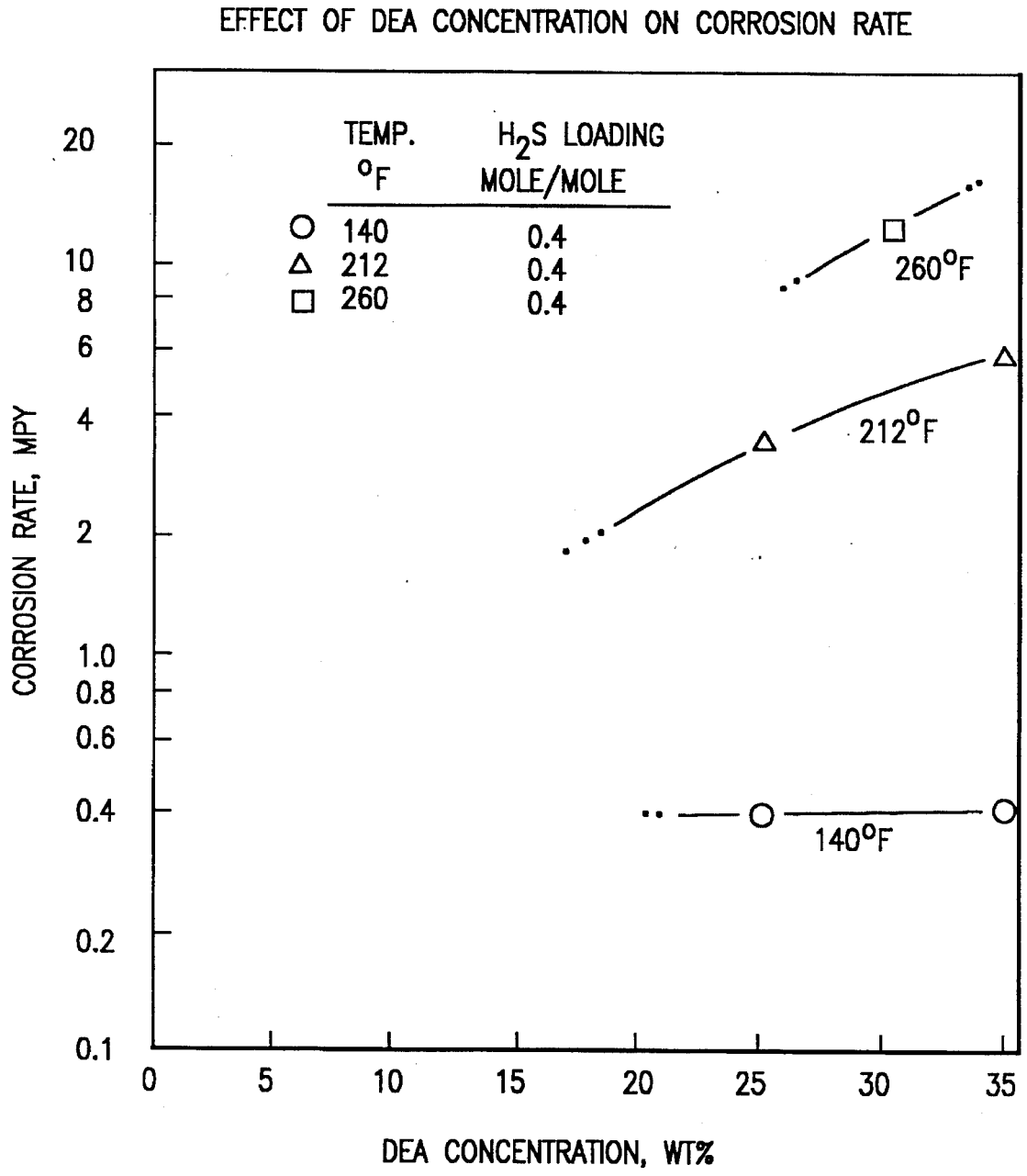

$H_2S$ loading was accomplished at ambient temperature using a Brooks mass flowmeter. The result was verified by measuring the change in solution weight. 80 ml of each solution were placed into a stainless steel pressure vessel. A carbon steel weightloss coupon (5.9 $cm^2$) was suspended in the liquid phase and the vessel was maintained at the test temperature for ten days by means of a Blue-M oven. The tests were representative of zero flow rate and pure $H_2S$ loading. The weight losses of the coupons after the test were determined and the corresponding corrosion rates were calculated in terms of mpy. The results are shown in Table 1 and FIGS. 1–3.

Effect of $H_2S$ Loading

Figure 1:
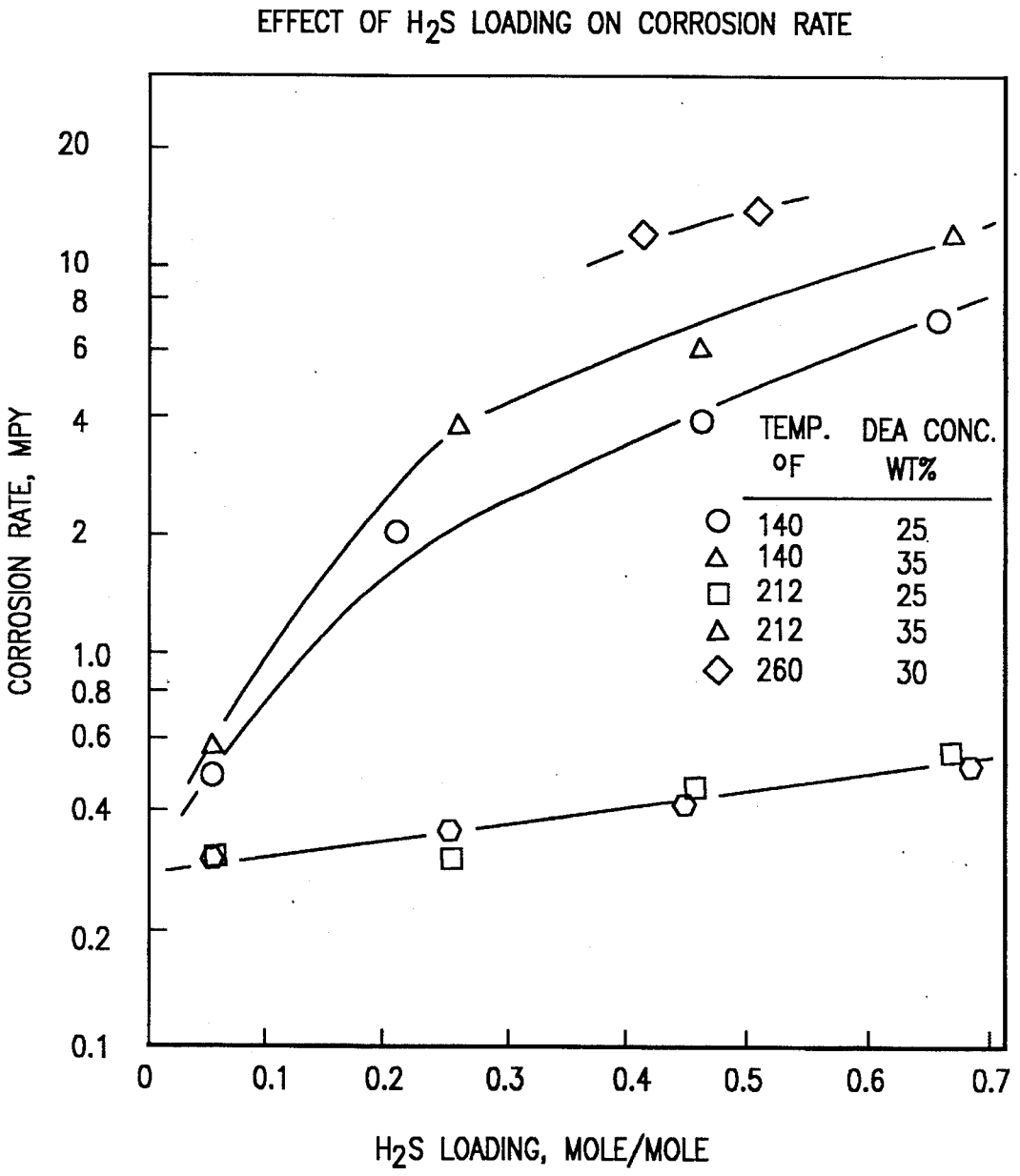
FIGS. 1–3 show the results of Examples 1–16, which illustrate the effects of $H_2S$ loading, test temperature, and alkanolamine concentration on corrosion rate.

The corrosion rates increased rapidly as the $H_2S$ loading was increased (FIG. 1). The corrosion rates increase was found to be particularly steep when the loadings were increased up to 0.25/mole/mole. The low $H_2S$ loading solution (below 0.05 mole/mole) was found to be much less corrosive than the high loading, rich solution of 0.4 mole/mole at the same condition. For 25% DEA solution at 212° F., the corrosion rates were 0.5 and 3.5 mpy, respectively. At low temperatures, the corrosion rates remained relatively low at all levels of $H_2S$ loading.

Effect of Temperature

The corrosion rate was found to increase rapidly with increasing process temperature is increased. By interpolation of the data in Table 1, the corrosion rates for 25% and 35% DEA solutions loaded to 0.4% $H_2S$ mole/mole of amine are plotted against temperature in FIG. 2.

Effect of Amine Concentrations

At the same $H_2S$ loading and temperature, corrosion rates were found to increase with an increase in amine concentration. The data are plotted in FIG. 3. The corrosion rate increase with amine concentration was found to be steeper at higher temperatures, as indicated by the slope of the lines.

CORROSION TEST RESULTS
Test Time, Day: 10
Coupon Material: C1018 Carbon Steel

| Example | Solution | $H_2S$ loading mole/mole | Temp. °F. | Corrosion Rate mpy |
|---|---|---|---|---|
| 1 | 25% Reagent DEA | 0.05 | 140 | 0.31 |
| 2 | " | 0.20 | 140 | 0.37 |
| 3 | " | 0.44 | 140 | 0.43 |
| 4 | " | 0.68 | 140 | 0.52 |
| 5 | " | 0.05 | 212 | 0.5 |
| 6 | " | 0.20 | 212 | 2.1 |
| 7 | " | 0.45 | 212 | 4.0 |
| 8 | " | 0.65 | 212 | 7.3 |
| 9 | 35% Reagent DEA | 0.05 | 140 | 0.31 |
| 10 | " | 0.25 | 140 | 0.31 |

-continued

CORROSION TEST RESULTS
Test Time, Day: 10
Coupon Material: C1018 Carbon Steel

| Example | Solution | $H_2S$ loading mole/mole | Temp. °F. | Corrosion Rate mpy |
|---|---|---|---|---|
| 11 | " | 0.45 | 140 | 0.46 |
| 12 | " | 0.66 | 140 | 0.55 |
| 13 | " | 0.05 | 212 | 0.5 |
| 14 | " | 0.25 | 212 | 4.9 |
| 15 | " | 0.45 | 212 | 6.1 |
| 16 | " | 0.66 | 212 | 12.0 |

Example 17: Synthesis of Anti-Corrosive Agent

The 1000 g of used DEA solution with the properties shown in Table 2 was heated to 250° C. for 1 hour. During the reaction, essentially all water was vaporized and a small quantity of light gas was also evolved. At the end of the reaction, 490 g of viscous organic liquid was obtained as the bottom product. This was the product which was found to be effective as an anti-corrosive agent. In addition to the anti-corrosive agent, this product also contained 70 wt % of free DEA. Thus the active anti-corrosive agent is believed to be a minor component of the total reaction product.

Corrosion Test

A "static" test procedure was selected to compare the corrosivities of solutions containing various amounts of additive to assess the effectiveness of the additive.

The corrosivities of the amine solutions were tested at:

Temperature, °F.: 140, 212, 240 and 260.

$H_2S$ loading, mole/mole amine: 0,0.05; 0.10, 0.25; 0.45, 0.5, and 0.66.

Amine concentration, wt %: 25 and 35.

$H_2S$ loading was accomplished at ambient temperature using a Brooks mass flowmeter. The result was verified by measuring the change in solution weight. 80 ml of each solution were placed into a stainless steel pressure vessel. A carbon steel weightloss coupon (5.9 $cm^2$) was suspended in the liquid phase and the vessel was maintained at the test temperature for ten days by means of a Blue-M oven. The tests are representative of zero flow rate and pure $H_2S$ loading. The weight losses of the coupons after the test was determined and the corresponding corrosion rates were calculated in terms of mpy.

Corrosion test results

The test results are shown in Table 3.

The results show that:

The additive has anti-corrosive properties, reducing corrosivity of the amine solution at unexpectedly low dosage. More particularly, the decrease in corrosion rate is a non-linear function of additive concentration. The corrosion rate decreased approximately 50% from 12.4 mils per year (Example 18) to 6.3 mils per year (Example 19) with the addition of only 5 weight percent additive.

Upon dilution with water (Example 21) the additive itself was found to be relatively low in corrosivity.

By use of the additive, the $H_2S$ loading can be increased from 4.31 to 5.20 wt % (i.e., 21% increase in absorption capacity) without increasing corrosivity. In fact, the corrosivity is lowered from 12.4 to 5.4 mpy. Thus, by use of the additive of the invention, the treating capacity of the system can be increased while decreasing the corrosivity of the solution.

Figure 4:
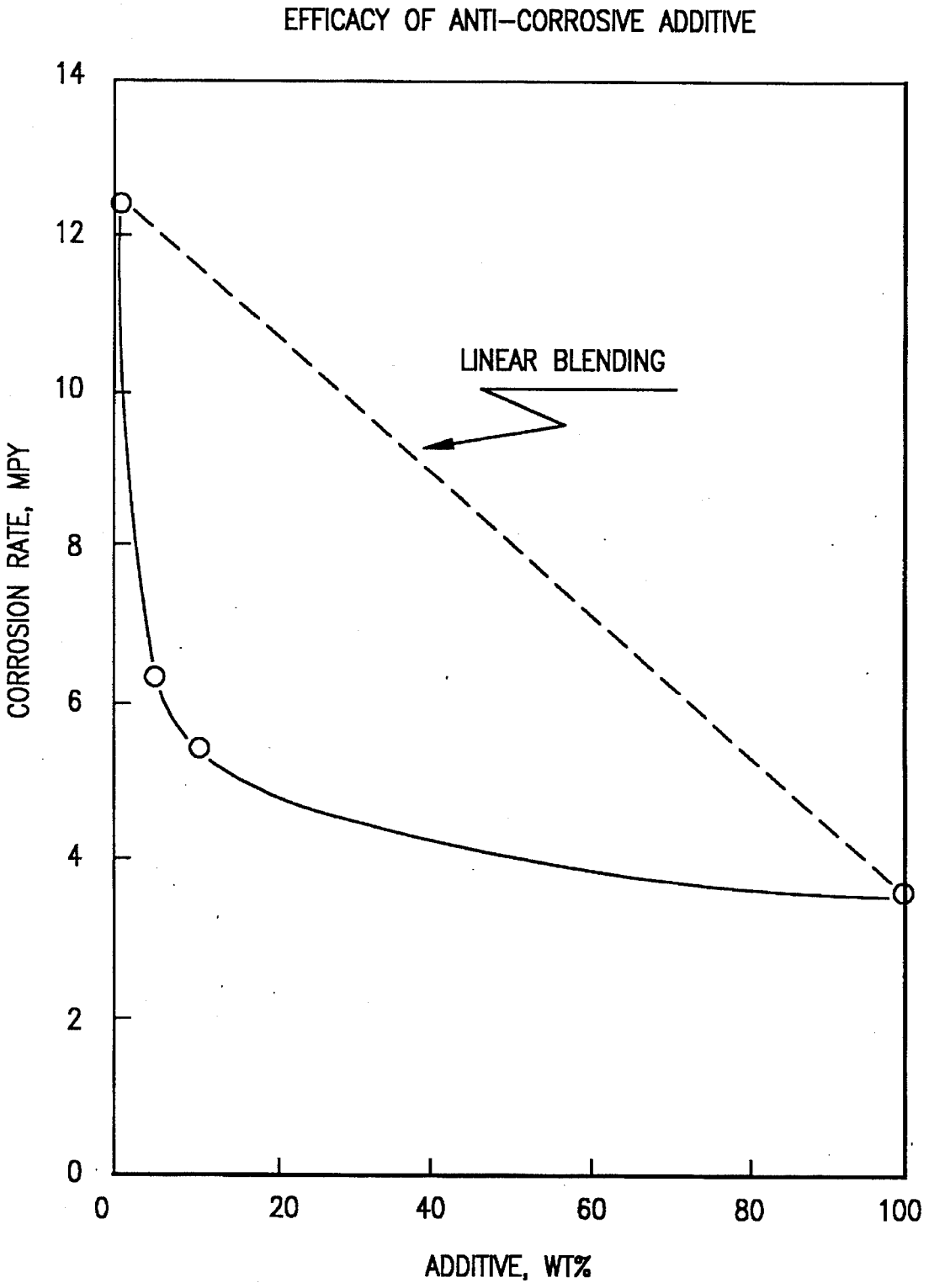
FIG. 4 shows the efficacy of the corrosion inhibitor of the invention effect in admixture with a spent aqueous ethanolamine solution.

These results are illustrated in FIG. 4. The spent diethanolamine solution (with no additive) is characterized by a corrosion rate on carbon steel of 12.4 mils per year, and is markedly more corrosive than the reaction product (the additive of the invention) which is characterized by a corrosion rate of 3.6 mpy. The synthesis of the invention appears not to convert the diethanolamine degradation byproducts solely to the parent alkanolamine because blending the reaction product back into a spent alkanolamine solution effects a nonlinear corrosion rate suppression. If the synthesis of the invention merely converted the spent alkanolamine to its parent alkanolamine, it is believed that the corrosivity of the mixture could be predicted by linear blending, shown as the straight dotted line in FIG. 4.

Blending only 5% of the reaction product (the additive of the invention) into a the spent diethanolamine solution characterized in Table 2 unexpectedly reduced the corrosion rate of the solution on carbon steel from 12.4 to 6.3 mils per year. In contrast, linear blending predicts 11.87 mils per year. This result shows that the anti-corrosive effect of the reaction product of the invention is disproportional to its concentration; this synergistic effect is surprising and unexpected, particularly in view of the relatively low concentration of the anti-corrosive agent in the reaction product of the invention. Example 20 confirms the effectiveness of the anti-corrosive agents of the reaction product produced in Example 19.

TABLE 2

Typical Used DEA Solution

| Component | Weight Percent |
|---|---|
| Free Amine | 28.5 |
| $H_2S$ | 0.1 |
| Amine Salts formed by the reaction of $CO_2$ and/or $H_2S$ with Diethanolamine including $(C_2H_4OH)_2NH_2COOH$ | 6.1 |
| Amides (including $(C_2H_4OH)_2N\overset{O}{\overset{\|\|}{C}}H$) | 14.8 |
| Ash* | 1.2 |
| Water | 49.3 |
| | 100.0 |

*Note:
Ash is a non-volatile inorganic residue such as clay and/or silica from antifoaming agents.

TABLE 3

Corrosion Results
Temperature, °C.: 240
$H_2S$ Loading, mol/mol DEA: 0.5
Test Time, days: 10

| Example No. | Sample | $H_2S$ Loading weight percent | Corrosion rate, mpy |
|---|---|---|---|
| 18. | Original DEA | 4.31 | 12.4 |
| 19. | Original DEA + 5% Additive | 4.77 | 6.3 |
| 20. | Original DEA + 10% Additive | 5.20 | 5.4 |
| 21. | 50% Additive + 50% | 5.03 | 3.6 |

TABLE 3-continued

Corrosion Results
Temperature, °C.: 240
$H_2S$ Loading, mol/mol DEA: 0.5
Test Time, days: 10

| Example No. | Sample | $H_2S$ Loading weight percent | Corrosion rate, mpy |
|---|---|---|---|
| | Water | | |

*Actual $H_2S$ loading is proportional to DEA concentration.

Changes and modifications in the specifically described embodiments can be carried out without departing from the scope of the invention which is intended to be limited only by the scope of the appended claims.

What is claimed is:

1. A method of decreasing the rate of corrosive attack of a liquid solution on ferrous metal-containing equipment of a petroleum refining unit said method comprising adding a corrosion inhibitor produced by the reaction of (a) an aqueous alkanolamine solution containing from about 10 to about 98 weight percent alkanolamine; with (b) the degradation products formed by reacting said alkanolamine with an acid gas; in the absence of added inorganic base at elevated temperatures of from about 180 to about 350 degrees Celsius for a reaction time of from about 0.1 to about 20 hours to produce a substantially water-free product, to said liquid solution in concentrations of from about 0.1 to about 8.0 weight percent.

2. The method of claim 1 wherein the concentration of said corrosion inhibitor is from about 1 to about 5 weight percent.

3. The method of claim 1 wherein said liquid solution is overhead condensate from a petroleum refinery crude unit distillation tower.

4. The method of claim 1 wherein said liquid solution contains naphthenic acid.

5. The method of claim 1 wherein said ferrous metal-containing equipment is at least one selected from the group consisting of conduit, valves, vessels, and heat exchangers for processing and/or condensing overhead vapors of said petroleum refining unit.

6. A method for disposing of a liquid hazardous waste stream containing an alkanolamine and degradation products formed by contacting said alkanolamine with an acid, said method comprising reacting said hazardous waste stream at elevated temperature of from about 180° to about 350° C. in the absence of added inorganic base for reaction time of from about 0.1 to about 20 hours to vaporize water from said hazardous waste stream to produce a substantially water-free product.

7. The method of claim 6 wherein said temperature is from about 200° to about 300° C.

8. The method of claim 6 wherein said reaction time is from about 0.1 to about 5 hours.

9. The method of claim 6 wherein said acid comprises the reaction product of water and at least one selected from the group consisting of CO, $CO_2$, and $H_2S$.

* * * * *